US005152475A

United States Patent [19]

Pasini

[11] Patent Number: 5,152,475

[45] Date of Patent: Oct. 6, 1992

[54] AXIALLY COMPRESSIBLE YARN WINDING WRAPS TUBE

[75] Inventor: Roberto Pasini, Milan, Italy

[73] Assignee: Tubettificio Europa S.P.A., Milan, Italy

[21] Appl. No.: 732,133

[22] Filed: Jul. 18, 1991

[30] Foreign Application Priority Data

Jul. 30, 1990 [IT] Italy ..... 21118 A/90

[51] Int. Cl.[5] ..... B65H 75/20

[52] U.S. Cl. ..... 242/118.1; 242/118.11

[58] Field of Search ..... 242/118.1, 118.11; 68/189, 198

[56] References Cited

U.S. PATENT DOCUMENTS

| | | | |
|---|---|---|---|
| 3,465,984 | 9/1969 | Tigges et al. | 242/118.11 |
| 4,181,274 | 1/1980 | Burchette, Jr. | 242/118.11 |
| 4,379,529 | 4/1983 | Nielsen | 242/118.11 |
| 4,560,116 | 12/1985 | Henning | 242/118.11 |
| 4,941,621 | 7/1990 | Pasini | 242/118.1 |
| 4,986,488 | 1/1991 | Windhosel et al. | 242/118.1 |
| 4,997,141 | 3/1991 | Pasini | 242/118.1 |

*Primary Examiner*—Stanley N. Gilreath

*Attorney, Agent, or Firm*—Beveridge, DeGrandi & Weilacher

[57] ABSTRACT

An axially compressible tubular carrier or dye tube for the winding of yarns; the carrier comprises end ring elements and intermediate ring elements interconnected with each other by flexible connecting elements which define the winding surface for the yarn. The connecting elements comprise rigid projections which are angularly spaced and extend axially from both sides of the intermediate ring elements and which define groups of projections in which the projections in each group are connected to the projections of a group of projections of an adjacent ring element by slanted and elastically flexible linking members whose inclination is reversed when the carrier is axially compressed.

19 Claims, 2 Drawing Sheets

AXIALLY COMPRESSIBLE YARN WINDING WRAPS TUBE

BACKGROUND OF THE INVENTION

The present invention relates to a tubular carrier or dye tube for the winding up of yarns, and more particularly concerns an axially compressible or collapsible tube which can be used for the winding and dyeing of textile threads and yarns; the axially compressible tube comprises a cylindrical or frustoconical winding surface for winding up yarns, defined by a set of coaxially arranged annular or ring elements which extend parallel to each other and which are connected by flexible linking elements.

Axially compressible tubular carriers or tubes for the winding and dyeing of yarns are known for example from U.S. Pat. No. 3,465,984. These carriers are substantially composed of a plurality of parallelly arranged annular or ring elements joined by flexible connecting elements which are suitably shaped so as to facilitate the axial compression of the tube. The yarn winding-up tubes according to U.S. Pat. No. 3,465,984 have considerable applicational limitations and drawbacks because they do not ensure a sufficient degree of the dimensional stability of the tube, both in the extended condition and in the compressed condition, on account of the elastic behaviour of the transverse elements connecting the rings.

Moreover, the axial compressibility of the tube cannot be correctly controlled in any way as would otherwise be desirable in order to ensure uniform and homogeneous compression and dyeing of the wound yarn. Furthermore, uniform axial unwinding of the yarn, after compression, may be partially prevented or compromised as a result of pinching of the yarn by projecting portions of said flexible connecting elements.

U.S. Pat. Nos. 4,181,274, 4,379,529, and EP-A-348721 disclose tubes which are axially compressible in a controlled manner, there being provided axially protruding elements between adjacent rings which prevent the ring members of the tube to move closer beyond a predetermined point. Although these documents suggest the use of rigid tube structures which are able to maintain a stable shape during winding of the yarn and which then yield axially during compression, they nevertheless do not solve completely and satisfactorily the problem of providing a tube having a stable structure both in the completely extended condition and in the compressed condition of the tube while maintaining it free from deformations or projecting parts so as to preventing the pinching and to allow correct unwinding of the yarn after the dyeing process. In particular, due to recovery or the spring back movement of the plastic material from which they are moulded, said tubes do not allow a structurally stable condition to be maintained upon removal of the compressive forces; furthermore, the shape and arrangement of the flexible elements connecting the rings which make up the tube may cause deformation or rotation of the rings themselves, negatively effecting both the dyeing operation and the unwinding of the yarn from the tube in the compressed condition.

U.S. Pat. No. 4,560,116 also discloses a carrier for yarns in the form of an axially compressible tube consisting of a plurality of annular elements provided with V-shaped portions axially aligned in parallel rows and peripherally arranged in relation to the tube. The V-shaped projections of a ring are connected to corresponding V-shaped projections of adjacent rings by flexible transverse connecting elements, which are inclined relative to the longitudinal axis of the tube and whose angle of inclination is reversed when the tube is in the compressed condition. Although such a tube structure ensures a certain degree of dimensional stability in the completely extended condition, so as to withstand the radial compressive forces exerted by the yarn during winding, it does not allow any control of axial compression degree and does not ensure any dimensional stability of the tube after compression. In fact, the V-shaped configuration of the projecting parts of the rings and their axially aligned arrangement do not prevent the individual rings of the tube from deforming radially and do not allow the tube to remain in a stable compressed condition which ensures easy axial unthreading of the yarn. Moreover, owing to the absence of stop elements between the ring members, during compression of the tube the V-shaped projections could cause the pinching and breakage of the yarn and the breakage of the transverse connecting elements, thus preventing uniform unwinding of the yarn.

The object of the present invention is to provide a tubular carrier or tube for receiving textile threads and yarns, particularly for dyeing operations, which is both axially compressible and which satisfies the following requirements:

a) it must have a degree of axial compression controlled by stop elements which limit the compression of the tube to a predetermined length b) it must not cause twisting and deformation with respect to the diameter of the tube during compression, and avoid pinching or breakage of the first turns of yarn directly wound onto the tube;

c) when the yarn is to be used, after dyeing, it must allow uniform unwinding and a complete unthreading of the yarn in the axial direction, so that all of the actual yarn can be used;

d) it must provide a tube structure that will ensure dimensional stability both in the extended and in the compressed condition of the tube, avoiding in this latter case any spring back movement and breakage of parts of the same tube.

A further object of the invention is to provide a tubular carrier for yarns which, in addition to ensuring the advantages referred to above, has an extremely simplified design, such that it can be manufactured by moulding from plastic materials, resulting in a tube structure which is integral and free of defects or of incorrectly formed and incomplete parts.

All of the above can be achieved by means of a yarn carrier in the form of an axially compressible tubular element comprising the characteristic features of the claims.

BRIEF DESCRIPTION OF THE DRAWINGS

A preferential embodiment of a tube for winding up yarns according to the invention will be illustrated in detail hereinbelow with reference to the accompanying drawings, in which.

DESCRIPTION OF THE INVENTION

Figure 1:
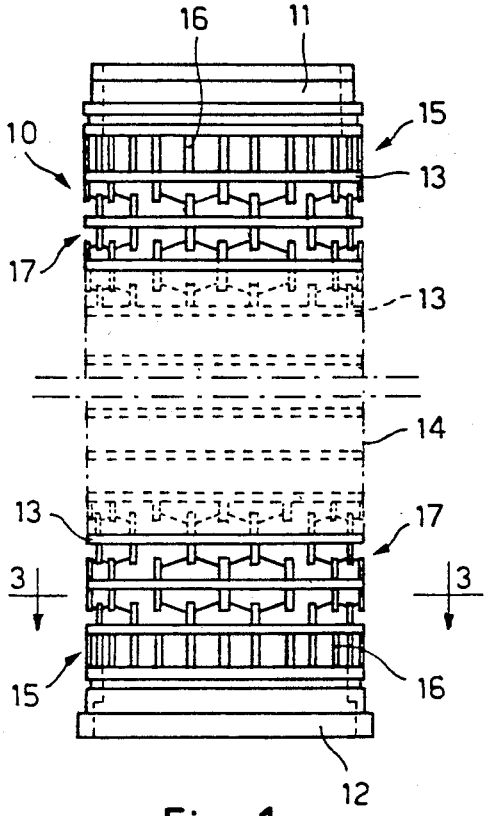
FIG. 1 is a plan view of the tube in the extended condition.

As shown in the extended condition of FIG. 1, the tube 10 comprises at both ends main end ring elements 11 and 12 suitably shaped so as to allow stacking of the tubes themselves; the tube body also comprises a plurality of intermediate ring elements 13 axially aligned with respect to each other and arranged parallel to each other, so as to define a winding surface 14 for winding-up yarn, said winding surface 14 having a cylindrical or conical shape depending on the required configuration of the tube.

The tube 10 at its two ends may have a first non-compressible section 15 comprising a plurality of rigid connecting elements 16, uniformly spaced out in a circumferential direction, which extend axially from each end ring elements 11 and 12 towards a first intermediate ring element 13.

Figure 2:
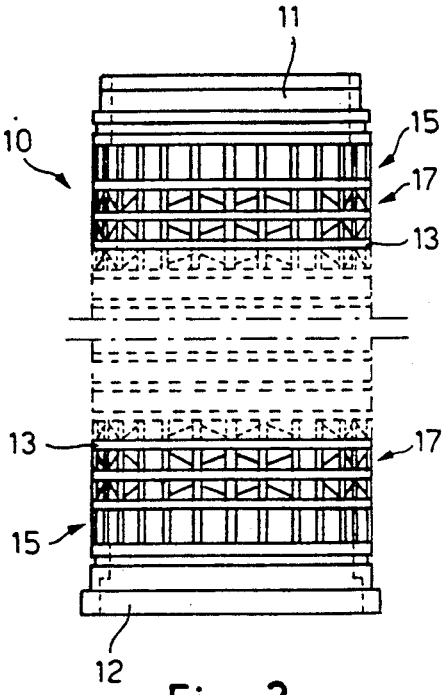
FIG. 2 is a plan view of the same tube in the axially compressed condition.
Figure 3:
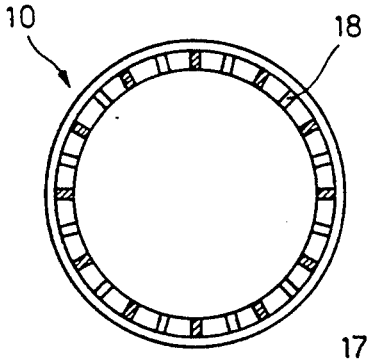
FIG. 3 is a cross-sectional view along the line 3—3 of FIG. 1.
Figure 4:
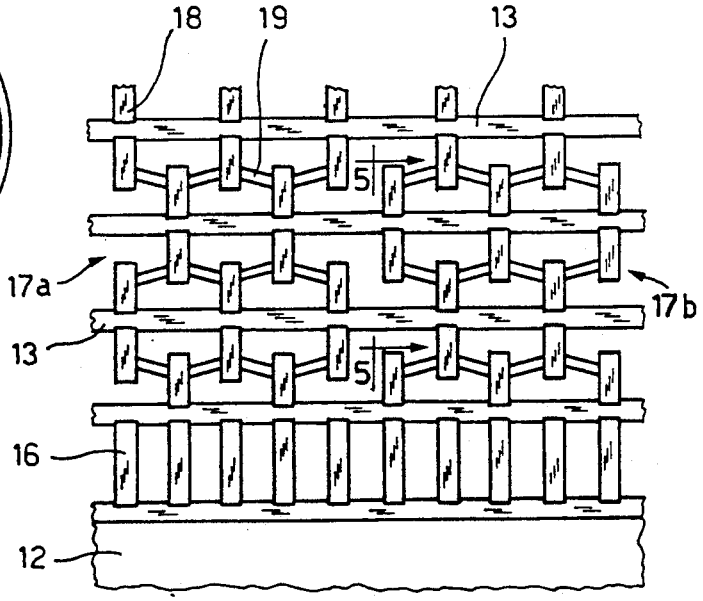
FIG. 4 is an enlarged and developed plan view of a portion of the tube of FIG. 1.

As shown in the same Figure and in the enlarged detail of FIG. 4, the intermediate ring elements 13 are joined together by connecting elements having an intermediate portion which is elastically flexible, i.e. is able to allow a controlled axial compression of the tube 10 maintaining its dimensional stability both in the extended condition of the tube (FIG. 1) and in the compressed condition shown in FIG. 2.

These flexible connecting elements 17 for the intermediate ring elements 13 comprise a plurality of rigid projections or bar members 18 which extend longitudinally on each side of the intermediate elements 13, with the exception of the end most ones; the bar members 18 have a predetermined length less than the distance initially existing between adjacent intermediate ring elements 13 in the extended and uncompressed condition of the tube shown in FIG. 1. The bar members 18 of each intermediate ring element 13 are uniformly spaced circumferentially with respect to each other and are located in intermediate positions with respect to the bar members 18 of the adjacent intermediate ring element so as to form alternate comb-like arrangements where each of the bar members of one intermediate ring element is disposed between bar members of an adjacent intermediate ring element. The bar members 18 of the intermediate ring element 13 therefore have a calculated length such as to permit the desired degree of axial compression of the tube 10; moreover, the bar members on one side of an intermediate ring element axially beyond the ends of the bar members on the opposite side of an adjacent intermediate ring element so as to define, with the intermediate ring elements 13, the winding surface 14 for winding up an yarn.

According to the present invention, as shown in detail in FIG. 4, the bar members 18 between two adjacent intermediate ring elements 13 are subdivided into groups of bar members denoted by 17*a* and 17*b* in FIG. 4, the bar members 18 of each group being interconnected by means of bridge connecting elements or elastically flexible linking members 19 which are alternately slanted in different or opposite directions with respect to the axial direction of the tube 10; the linking members 19 preferably form an angle of between 15° and 22°. In general their inclination must be such as to allow a controlled axial compression of the tube 10 and reversal of the inclination itself in the compressed condition of the tube 10, as will be explained below, so that the tube shape behaves stably both in the extended condition shown in FIG. 1 and in the compressed condition shown in FIG. 2.

Figure 5:
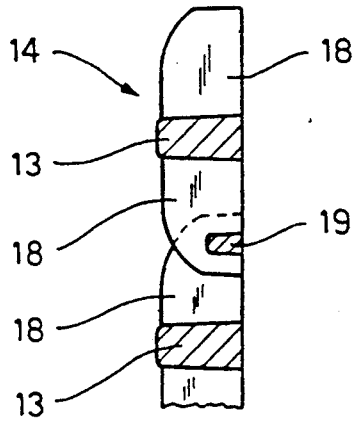
FIG. 5 is an enlarged sectional view along the line 5—5 of FIG. 4.

Overall, therefore, the tube 10 assumes a tubular shape with a mesh-like structure so as to allow winding-up of the yarn and passage of the dye bath in a uniform and homogeneous manner. The configuration of the intermediate ring elements 13, the bar members 18 and the linking members 19 as well as their arrangement must be such so as to prevent distortion of the tube 10 and the formation of projecting parts with respect to the yarn winding surface 14, which could damage or cause pinching of the yarn during compression of the tube. For this purpose, as shown in the section in FIG. 5, the fore or external surface of each bar member 18 is flat shaped and is arranged slightly set back with respect to the external peripheral surface of the intermediate ring elements 13; the end of the same bar member has a rounded external edge so as to pervent the bar member interfering with the turns of wound yarn when the tube 10 is compressed or collapsed.

Similarly, the flexible linking members 19 are slightly set back with respect to the yarn winding surface 14 defined by the external edge of the bar members 18 and intermediate ring elements 13 of the tube 10.

Figure 6:
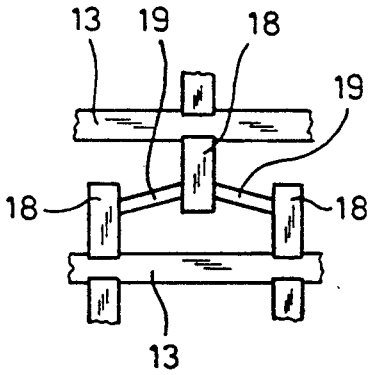
FIGS. 6, 7 and 8 show enlarged details of the tube of FIG. 1, illustrating in plan view the three most important moments during axial compression of the tube, from the condition in FIG. 1 to the condition in FIG. 2.
Figure 7:
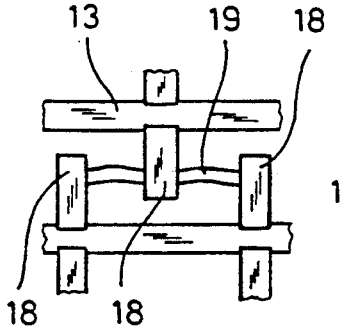
Figure 8:
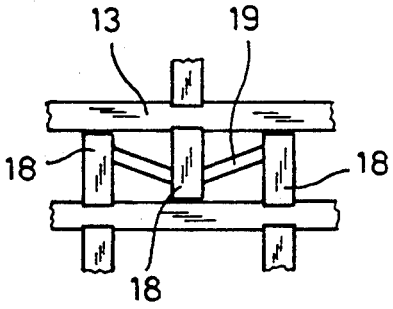

With reference now to FIGS. 6, 7 and 8, we shall describe the mode of operation of the tube 10 during the transition from the extended condition of FIG. 1 to the compressed condition of FIG. 2.

As previously mentioned, the bar members 18 of the intermediate ring elements 13 are subdivided into groups, each group forming a connecting element 17 with the bar members of each connecting element 17 being interconnected by flexible linking members 19; as shown in FIG. 4, each group of bar members 18 in a connecting element 17 is separate and distinct from the adjacent connecting elements 17, that is to say the bar members 18 at the ends of the two adjacent connecting elements 17 are not connected by linking members 19. Therefore, each group of bar members 18 in a connecting element 17 is able to undergo stresses and slight flexures in the circumferential direction completely independent of the groups of bar members 18 in an adjacent connecting element 17 thereby ensuring a stable axial compression of the tube 10 without dangerous deformations. Moreover, this keeps the intermediate ring elements 13 axially aligned relative to each other and free from distorsions. In particular, the points where the linking members 19 join the two adjacent bar members 18 are set back slightly with respect to the ends of the bar members themselves.

If we examine, therefore, FIGS. 6, 7 and 8 of the drawings, FIG. 6 shows the arrangement of two intermediate ring elements 13 and three adjacent bar members 18, i.e. one bar of the upper intermediate ring element and two bar members of the lower intermediate ring element which bar members are joined by the linking members 19, in the condition which these parts assume when the tube 10 is completely extended or not compressed, as shown in FIG. 1. In this condition, the intermediate ring elements 13 are unable to move away from each other, or to move towards each other or to rotate, this being prevented by the linking members 19 connecting the bar members 18 and by the slanted arrangement of the linking members 19 themselves. In this condition, the bar members 18 of one intermediate ring element 13 are spaced apart from the adjacent intermediate ring element 13 extending a certain amount beyond the ends of the bar members of the latter. The tube 10 in the extended condition therefore has a structure which is highly stable with respect to the radial compressive stresses caused by winding-up of the yarn.

When the tube 10 must be compressed inside a dyeing autoclave, the tube is made to collapse, thus causing the intermediate ring elements 13 to move towards each other without undergoing rotations of distortions remaining centred until the bar members 18 of each intermediate ring element stop against the opposite surface of next intermediate ring element, FIG. 8, thus acting as stop elements for stopping the intermediate ring elements 13 and controlling the degree of axial compressibility of the tube 10. As can be seen in FIG. 8, after compression, the linking members 19 have an inclination which is reversed compared to that of FIG. 6; in order to reach this condition they have to pass through the intermediate condition of FIG. 7 in which the linking members 19 are elastically compressed; therefore, during the transition from the condition of FIG. 7 to that of FIG. 8 they behave like an elastically loaded spring, suddenly reversing their inclination after completely discharging the elastic compression previously stored. Therefore, the tube 10 will be stably self-held in its new compressed configuration shown in FIG. 2, in which the bar member 18 are all in contact with opposite intermediate ring elements 13 so as to offer a practically continuous surface for supporting the yarn. Therefore, the yarn can be axially wound in a uniform and continuous manner, without being pinched or retained by the tube 10 or encountering projecting parts which could pervent unthreading.

From the explanations and illustrations it is therefore obvious that an axially compressible tubular carrier for textile threads and yarns has been provided, comprising intermediate ring elements which are arranged parallel and coaxial relative to each other and are provided with axially projecting bar members or rigid elements for stopping the intermediate ring elements. The said bar memebers and the intermediate ring elements define the yarn winding surface. Groups of bar members between adjacent intermediate ring elements are connected by elastically flexible linking members arranged at an angle with respect to the axial direction of the carrier. The intermediate ring elements of the yarn carrier are provided with axially oriented stop means which allow the maximum compression of the tube to be controlled, causing reversal of the angles of orientation of the flexible linking members connecting the bar members. In this way, a carrier for yarns is achieved in the form of a tubular element with a meshwork structure, designed to allow the passage of fluids for the treatment of yarns, said carrier having a highly stable shape which is not subject to deformations of the yarn winding surface both in the extended and in the compressed condition of the carrier. Therefore, it will be understood that the explanations and illustrations with reference to the accompanying drawings have been provided solely by way of example of the innovative principles of the claimed invention.

What is claimed is:

1. A carrier for winding-up yarns the carrier being in the form of an axially compressible tubular element comprising:

intermediate ring elements axially aligned and arranged parallel to each other, and end ring elements, each connected to an intermediate ring element, said intermediate ring elements being interconnected by flexible connecting elements each having at least one elastically flexible linking member, said elastically flexible linking members being arranged at an angle with respect to the axial direction of the carrier, and a plurality of axially projecting bar members uniformly spaced apart on at least one side and over the entire periphery of the plurality of ring elements, the bar members of an intermediate ring element being arranged in intermediate positions and extending beyond the ends with respect to facing bar members of an adjacent intermediate ring element, wherein facing bar members of adjacent intermediate ring elements are provided into independent groups of bar members in which the bar members on an intermediate ring element are connected by said elastically flexible linking members to bar members on an adjacent intermediate ring element.

2. A carrier according to claim 1, in which said bar members have an external yarn-winding surface which is set-in slightly with respect to the external surface of said intermediate ring elements.

3. A carrier according to claim 2, in which the said bar members have a flat ecternal surface.

4. A carrier according to, claim 1, wherein an external edge at the ends of said bar members has an inwardly curved profile.

5. A carrier according to claim 1, wherein said elastically flexible linking members form an angle of between 15° C. and 22° C. with respect to the axial direction of the carrier.

6. A carrier according to claim 1, wherein points where said elastically flexible linking members join said bar members are se t back with respect to the ends of the bar members themselves.

7. A carrier according to claim 1, in which a rigid non-compressible section is provided between the end ring elements ans an intermediate ring element.

8. A carrier according to claim 1, wherein the length of said bar members, the length of said elastically flexible linking members, and the angle formed by said elastically flexible linking members with the axial direction of said carrier are formed so as to maintain said elastically flexible linking members in an unstressed and stable condition in an extended condition and in an axially compressed condition of said carrier.

9. A carrier according to claim 1, wherein said elastically flexible linking members are arranged alternately slanted in opposite directions with respect to said bar members.

10. A carrier for winding up yarns, the carrier being in the form of an axially compressible tubular element comprising:

intermediate ring elements, axially aligned and arranged parallel to each other, end ring elements, each connected to an intermediate ring element, and flexible connecting means for connecting said intermediate ring elements together, said flexible connecting means having a plurality of axially projecting bar members and a plurality of elastically flexible linking members, said bar members being uniformly spaced apart on both sides and over the entire periphery of each of a plurality of said intermediate ring elements, said bar members of one intermediate ring element being arranged in intermediate positions and extending axially beyond ends of facing bar members of an adjacent intermediate ring element, and wherein facing bar members of adjacent intermediate ring elements are formed into independent groups of bar members, said bar members of a group on an intermediate ring element being connected by at least one elastically flexible linking member to said bar members on an adjacent intermediate ring element.

11. A carrier according to claim 10, wherein said elastically flexible linking members are arranged alternately slanted in opposite directions with respect to said bar members, and are arranged at an angle with respect to an axial direction of said carrier.

12. A carrier for winding up yarns, the carrier being in the form of an axially compressible tubular element comprising:

ring elements, axially aligned and arranged parallel to each other, flexible connecting means for connecting said ring elements together, said flexible connecting means having a plurality of axially projecting bar members, and a plurality of elastically flexible linking members, said bar members being uniformly spaced apart on at least one side of the periphery of each of said ring elements facing bar members of an adjacent ring element, wherein facing bar members of adjacent ring elements are formed into a group of bar members, at least one bar member of a group on a ring element being connected by at least one elastically flexible linking member to a bar member on an adjacent ring element, said elastically flexible linking members being arranged at an angle with respect to an axial direction of said carrier.

13. A carrier according to claim 12, wherein said bar members have an external yarn-winding surface which is set-in slightly with respect to the external surface of said intermediate ring elements.

14. A carrier according to claim 12, wherein the external edge at the ends of the said bar members has an inwardly curved profile.

15. A carrier according to claim 12, wherein said elastically flexible linking members form an angle of between 15° and 22° with respect to the axial direction of the carrier.

16. A carrier according to claim 12, wherein said bar memebers have a flat external surface.

17. A carrier according to claim 12, wherein points where said elastically flexible linking members joins the bar members are set back with respect to the ends of the bar members themselves.

18. A carrier according to claim 12, wherein the length of the bar members, the lengths of said elastically flexible linking members and the angle formed by said elastically flexible linking members with the axial direction of the carrier are such as to maintain said elastically flexible linking members in an unstressed and stable condition both in and extended and in an axially compressed condition of the carrier.

19. A carrier according to claim 12, wherein said elastically flexible linking members are arranged alternately slanted in opposite directions with respect to said bar members, and are arranged at an angle with respect to an axial direction of said carrier.

* * * * *